US009481966B2

(12) United States Patent
Frelich

(10) Patent No.: US 9,481,966 B2
(45) Date of Patent: Nov. 1, 2016

(54) HOPPER ASSEMBLY FOR PAVING MACHINES

(71) Applicant: CATERPILLAR PAVING PRODUCTS INC., Brooklyn Park, MN (US)

(72) Inventor: Toby A. Frelich, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/887,330

(22) Filed: Oct. 20, 2015

(65) Prior Publication Data

US 2016/0040368 A1 Feb. 11, 2016

(51) Int. Cl.
*E01C 19/18* (2006.01)
*E01C 19/48* (2006.01)

(52) U.S. Cl.
CPC ..... *E01C 19/48* (2013.01)

(58) Field of Classification Search
CPC ..... E01C 19/48
USPC ..... 404/108, 110
See application file for complete search history.

(56) References Cited

U.S. PATENT DOCUMENTS 3,054,334 A * 9/1962 Barber ..... E01C 19/4853 404/108
5,356,238 A * 10/1994 Musil ..... E01C 19/008 404/101
5,722,790 A * 3/1998 Spray ..... E01C 19/48 404/108
6,007,272 A * 12/1999 Macku ..... E01C 19/1077 366/319
6,086,287 A * 7/2000 Sharpe ..... E01C 19/4873 404/101
6,375,386 B1 4/2002 Macku et al.
8,021,078 B2 9/2011 Lamb
9,151,004 B2 * 10/2015 Anderson ..... E01C 19/48
2014/0037375 A1 2/2014 Frelich et al.
2015/0132058 A1 5/2015 Anderson et al.
2016/0060823 A1 * 3/2016 Erdtmann ..... E01C 19/48 404/110

FOREIGN PATENT DOCUMENTS

FR EP 0517579 A1 * 12/1992 ..... E01C 19/48
GB 1385929 3/1975
JP 4965608 7/2012
JP 5268788 8/2013

* cited by examiner

*Primary Examiner* — Thomas B Will
*Assistant Examiner* — Katherine Chu

(57) ABSTRACT

A paving machine includes a hopper assembly movable between a lowered position and a raised position and a conveyor frame. A first hopper is pivotally connected to the conveyor frame at a first hopper axis and a second hopper is pivotally connected to the conveyor frame at a second hopper axis. A first apron is connected to the first hopper about a first apron axis. A second apron is connected to the second hopper about a second apron axis. The first apron axis and the second apron axis are respectively perpendicular to the first and second hopper axis. A central apron is pivotally connected relative to the conveyor frame about a central axis that is inline to the first and second apron axis in the lowered position. The first and the second apron axis are planarly translated to the central axis from the lowered to the raised position.

1 Claim, 5 Drawing Sheets

HOPPER ASSEMBLY FOR PAVING MACHINES

TECHNICAL FIELD

The present disclosure relates generally to a hopper assembly of a paving machine. More specifically, the present disclosure relates to apron wing portions of the hopper assembly that includes a hinge that is substantially inline to a hinge of a central apron wing portion of the hopper assembly.

BACKGROUND

Paving machines are commonly used to lay asphalt/concrete on roads, bridges, parking lots, and other construction sites. Such machines are generally supplied with hopper assemblies and conveyor portions that facilitate an intake, delivery, and a distribution of a quantity of a road forming material, such as asphalt, concrete, and bitumen, to form a road surface. Hopper assemblies in such machines are generally assembled as a twin hopper set, with each hopper facing each other and being positioned symmetrically on either sides of the conveyor portion. The twin hopper set is configured to switch between a lowered position and a raised position. Generally, the twin hopper set receives the road forming material in the lowered position of the hopper assembly, while in the raised position the twin hopper set facilitate transfer of the road forming material to the conveyor portion by gravity feed. Thereafter, the conveyor portion transfers the road forming material to an auger of the machine, in turn delivering the road forming material to the work site as a stockpile.

Each hopper includes an apron and an apron wing portion. Aprons and apron wing portions are generally pivotally attached to each of the hoppers. In the process of delivering the road forming material from the hoppers to the conveyor portion by gravity feed, the aprons typically simultaneously swing upwards relative to the hoppers so as to contain a transmission of the road forming material. However, as the delivery is in progress, it may happen that an outflow of the road forming material is refrained from being substantially entirely supplied to the conveyor portion. This is because the pivotal connection between the apron wing portions and the hopper is generally angled relative to the axis of swing that exists between the hoppers and the conveyor portion. As a result, a narrower path is defined for the road forming material to flow out of each of the hopper. Further, the pivotal connection between the apron wing portions and the hopper forms an acute-angled corner spot, where there is an increased chance for a portion of the road forming material to be unduly retained. Such a situation, when accompanied with the adhesive forces present in the road forming material, further lead to accumulation of the road forming material in the acute-angled corner spot and an inevitable wastage of the road forming material.

United States Patent Application US 20150132058 relates to an automated hopper and apron control system that assists an operator of the machine to work in an efficient manner. However, the '058 reference does not discuss any means by which road forming materials that is loaded into the hopper assembly are prevented from becoming stuck between the apron wing portions and the hoppers. Neither does the '058 reference disclose a system by which road forming materials may be substantially entirely transferred to the hopper assembly.

Accordingly, the system and method of the present disclosure solves one or more problems set forth above and other problems in the art.

SUMMARY OF THE INVENTION

Various aspects of the present disclosure illustrate a paving machine. The paving machine includes a conveyor portion with a conveyor frame and a hopper assembly. The hopper assembly is in communication with the conveyor portion and movable between a lowered position and a raised position. The hopper assembly includes a first hopper pivotally connected to the conveyor frame about a first hopper axis, and a second hopper pivotally connected to the conveyor frame about a second hopper axis. Further, a first apron is included, which has a first wing portion. The first wing portion is pivotally connected to the first hopper about a first apron axis. Similarly, a second apron with a second wing portion is included. The second wing portion is pivotally connected to the second hopper about a second apron axis. The first apron axis and the second apron axis are respectively and substantially perpendicular to the first hopper axis and the second hopper axis. The hopper assembly includes a central apron, which is pivotally connected relative to the conveyor frame about a central axis. The first apron axis and the second apron axis are substantially inline to the central axis in the lowered position of the hopper assembly, and that the first apron axis and the second apron axis are substantially planarly translated relative to the central axis upon a transition of the hopper assembly from the lowered position to the raised position.

DETAILED DESCRIPTION

Figure 1:
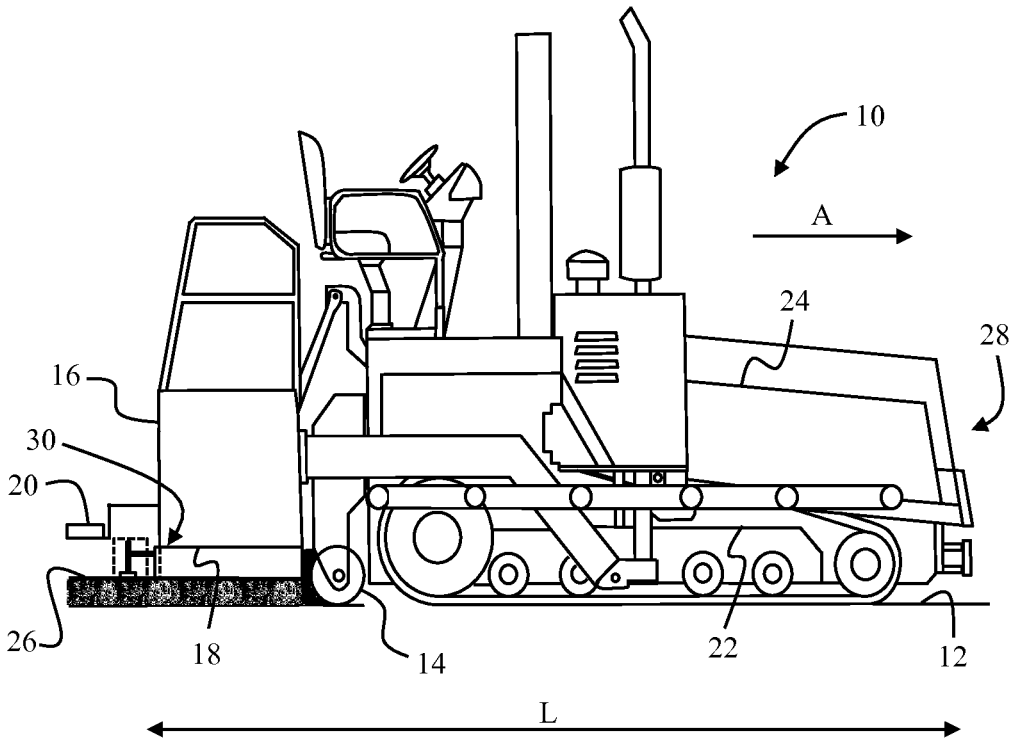
FIG. 1 is a side view of an exemplary paving machine incorporated with a hopper assembly, in accordance with the concepts of the present disclosure.

Referring to FIG. 1, there is shown an exemplary paving machine 10, which operates over a non-paved surface 12 and paves the non-paved surface 12. The paving machine 10 may be an asphalt paver. To perform the paving operation, the paving machine 10 includes a variety of components, such as an auger 14, a screed 16, an end gate 18, a walk-platform 20, a conveyor portion 22 (best shown in FIG. 2), and a hopper assembly 24. The paving machine 10 also provides relative compaction to a road forming material that is delivered to the non-paved surface 12. The road forming material may be one of asphalt, bitumen, or concrete, or a mixture of these, although other known materials may also be contemplated. A fully formed paved surface may be referred to as a mat 26. Further, a machine movement may be executed along a direction, A, as shown. Further, the paving machine 10 includes a front end 28.

The auger 14 is configured to receive and lay the road forming material on the non-paved surface 12. The auger 14 may embody a screw conveyor, which may include a mechanism that uses a helically shaped screw blade known as flighting. A rotation of such a screw conveyor may dump the road forming material as a stockpile over the non-paved surface 12.

The screed 16 may be controllable and panned to evenly spread the dumped stockpile over the non-paved surface 12, depending on a desired width of the mat 26. The screed 16 may provide at least a minimal compaction to the underlying stockpile to form the mat 26. In that way, the screed 16 addresses a preliminary compaction requirement of the mat 26. A disposal of the stockpile may be such that a flattened, planer layer of the stockpile is substantially uniformly laid-out on the non-paved surface 12, as the paving machine 10 proceeds in the direction, A.

The end gate 18 may be fixedly engaged along the ends of the screed 16. As the screed 16 assists in the formation of the mat 26, the end gate 18 may restrict the unrequited spread of the stockpile beyond the specified limits, and may comply to form a desired width of the mat 26. The end gate 18 includes a first end 30 that lies in proximity to the screed 16. The end gate 18 is generally attached to the screed 16 and moves with the screed 16 to prevent undesirable spillage of the road forming material over an adjacent, unpaved surface. Such movement of the end gate 18 with the screed 16 generally results in the formation of an edged margin between the mat 26 and an adjacent unpaved surface along an expanse of the associated roadway.

The walk-platform 20 may be installed adjacent to the screed 16, and towards the first end 30. The walk-platform 20 is generally a walkway that enables an operator to stand and observe the paving process. While being positioned on the walk-platform 20, various aspects of the mat 26, such as leveling of the mat 26, surface finish, mat width, and/or the like, may be inspected by the operator.

Figure 2:
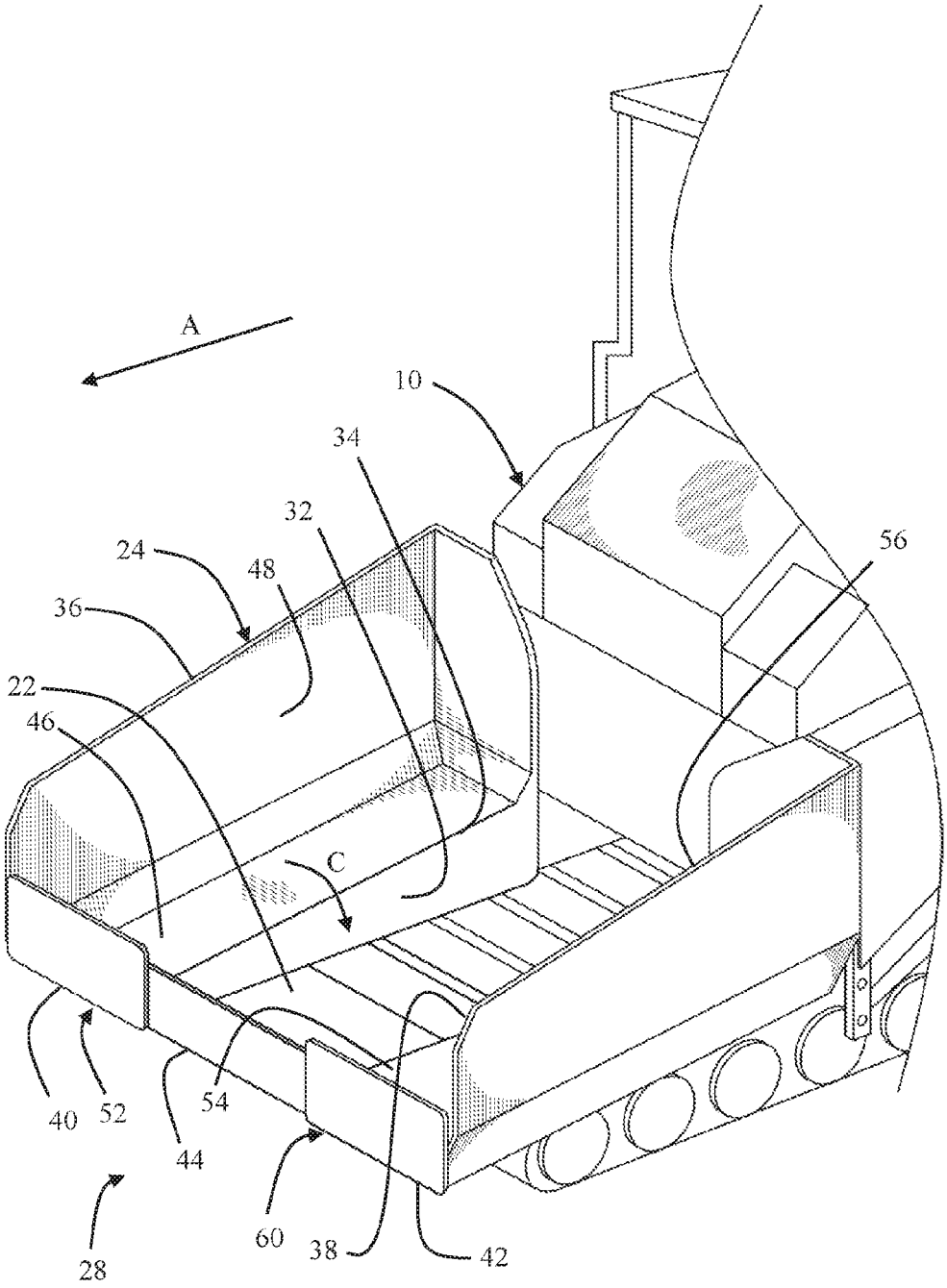
FIG. 2 is a partial perspective view of the paving machine of FIG. 1, showing the hopper assembly of FIG. 1, in accordance with the concepts of the present disclosure.

Referring to FIGS. 1 and 2, the paving machine 10 is inclusive of the conveyor portion 22. The conveyor portion 22 includes a conveyor frame 32, which is defined and deployed along a length, L, (FIG. 1) of the paving machine 10. The conveyor portion 22 is positioned relative to the hopper assembly 24 so as to be able to receive the road forming material from the hopper assembly 24, and thereafter deliver the road forming material to the auger 14. The conveyor portion 22 may serve to move the road forming material rearwardly, through a tunnel (not shown) defined in the paving machine's engine compartment, and, subsequently, to a spreading or distribution mechanism (not shown). Parameters related to the conveyor portion 22 such as, for example, length, use of single or multiple conveyors, etc., may vary without any limitation.

Referring to FIG. 2, the front end 28 of the hopper assembly 24 is shown. The hopper assembly 24 is configured to receive the road forming materials from a dump truck (not shown) or by known material transfer means. The hopper assembly 24 is communicable with the conveyor portion 22 so as to deliver the road forming materials to the conveyor portion 22. A portion related with the delivery of the road paving materials to the conveyor portion 22 is designated as an outflow path 34, as shown. Further, the hopper assembly 24 is movable from a lowered position to a raised position, so as to facilitate dumping of a quantity of the road forming material to the conveyor portion 22. The hopper assembly 24 includes a first hopper 36, a second hopper 38, a first apron 40, a second apron 42, and a central apron 44.

The first hopper 36 is generally L-shaped and defines a material receipt portion 46 and a material support portion 48. Generally, the material receipt portion 46 is a planarly extended flat region into which an amount of the road forming material is received during operations, while the material support portion 48 prevents the road paving materials from a fallout. Other shapes and configurations of the material receipt portion 46 may be contemplated, such as having a jagged floor profile, an arcuate floor profile. The material receipt portion 46 is nearly perpendicular to the material support portion 48 to define the L-shaped layout of the first hopper 36. In the lowered position, the material receipt portion 46 is defined along the horizontal, while the material support portion 48 is defined along the vertical. In the raised position, however, this configuration is altered and the material receipt portion 46 and the material support portion 48 may assume varying angular positions relative to the vertical and the horizontal, as is required to deliver the road paving material to the conveyor portion 22. The material receipt portion 46 is pivotally connected with the conveyor frame 32 so as to facilitate a pivotal movement of the first hopper 36 about a first hopper axis 50 (FIG. 3) relative to the conveyor portion 22. In so doing, it is ensured that the first hopper 36 is switchable between the raised position and the lowered position. The first hopper axis 50 is generally extended along the extension of the conveyor frame 32 (or along the length, L, of the paving machine). This is to ascertain that the pivotal movement of the first hopper 36 occurs substantially about an elongation that is parallel to the length, L, of the paving machine 10. Further, the first hopper 36 defines a first front end 52 relative to the paving machine 10.

Figure 3:
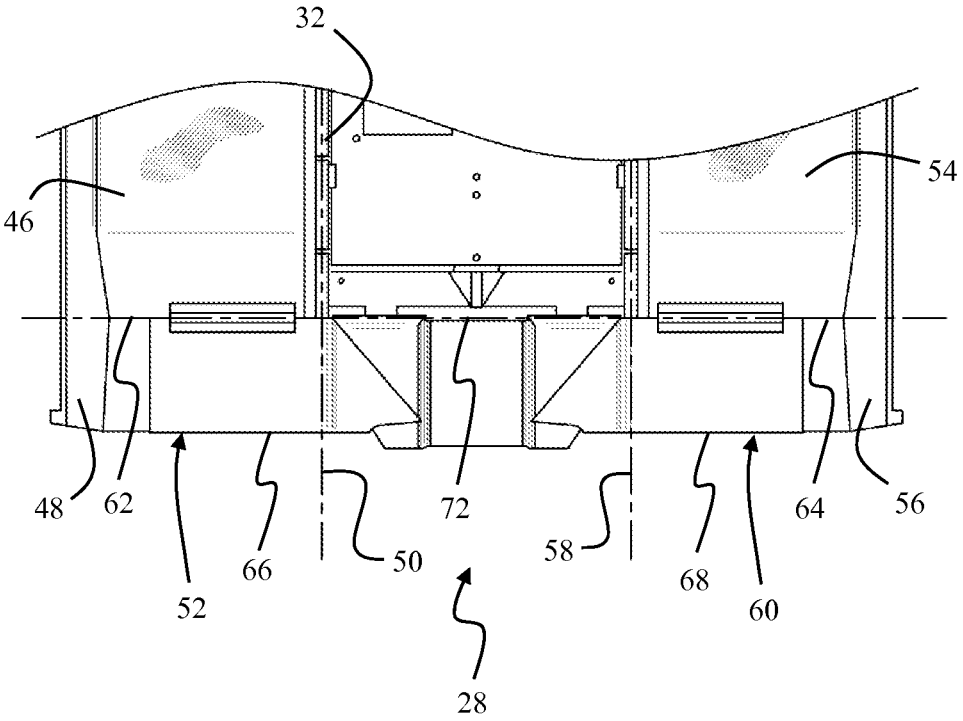
FIG. 3 is a partial top view of the hopper assembly in a lowered position, depicting a layout of apron wing portions of the hopper assembly of FIG. 1, in accordance with the concepts of the present disclosure.

The second hopper 38 is similar to the first hopper 36 in form and function. However, the second hopper 38 is symmetrically laid out oppositely to the first hopper 36. As with the first hopper 36, the second hopper 38 includes an auxiliary material receipt portion 54 and an auxiliary material support portion 56, which are perpendicular to each other. Since the second hopper 38 is laid out symmetrically opposite relative to the first hopper 36, the second hopper 38 is imparted with an inverted L-shaped configuration thus forming a mirror image of the first hopper 36, when viewed from the front end 28 of the paving machine 10. As a result, the second hopper 38 is symmetrically identical to the first hopper 36, both in structure and in deployment. As with the connection of the first hopper 36 with the conveyor frame 32, the second hopper 38 is pivotally connected the conveyor frame 32 about a second hopper axis 58 (FIG. 3). Collectively, the first hopper 36 and the second hopper 38 form the hopper assembly 24. Given this configuration between the first hopper 36 and the second hopper 38, a frontal view of the hopper assembly 24 resembles a cross-section of a cup shaped unit in the lowered position of the hopper assembly 24, and which is prepared to receive the road forming material. As with the first hopper 36, the second hopper 38 defines a second front end 60 of the paving machine 10.

Effectively, both the first hopper 36 and the second hopper 38 are pivotally movable respectively about the first hopper axis 50 and the second hopper axis 58. In that way, the first hopper 36 and the second hopper 38 facilitates the switch of the hopper assembly 24 between the lowered position and the raised position. It may be contemplated that the operations of the first hopper 36 and the second hopper 38 are executed simultaneously. However, operations of the first hopper 36 and the second hopper 38 may be executed separately as well.

The first apron 40 is positioned at the first front end 52 of the first hopper 36, at substantially right angles to both the material receipt portion 46 and the material support portion 48 of the first hopper 36. In that way, a disposal of the first apron 40 is substantially lateral to a forward deployment of the paving machine 10. The first apron 40 is a generally planarly formed component, which is operably positioned at the first front end 52, although other forms and configurations, such as those having an arcuate shape may be considered. Such an arrangement ensures that a material fallout is restricted from the first front end 52 of the first hopper 36, both in the lowered position and in the raised position of the hopper assembly 24.

Similarly, the second apron 42 is positioned at the second front end 60 of the second hopper 38, with a positioning as has been provided for the first apron 40. The second apron 42 is substantially similar to the first apron 40 in form and function, and is arranged to prevent a material fallout from the second hopper 38, in either of the lowered position and the raised position of the hopper assembly 24. With both the aprons 40 and 42 in place, a material fallout from the front end 28 of the paving machine 10 (or the hopper assembly 24) is effectively restricted. Such a restriction is attained even while the paving machine 10 is in motion.

The central apron 44 is included as part of the hopper assembly 24. The central apron 44 facilitates the general lifting of the first apron 40 and the second apron 42. The central apron 44 is positioned relatively midway to the position of the first apron 40 and the second apron 42. In an exemplary embodiment, the central apron 44 is operable between a lifted position and a retracted position so as to enable the operation of the first apron 40 and the second apron 42 about a first apron axis 62 and a second apron axis 64 (FIG. 3). Such operations may be provided by hydraulic actuators, electrical actuators, or by other known actuation systems that may be connected to the central apron 44. Cumulatively, the first apron 40, the second apron 42, and the central apron 44, are set to prevent a material fallout from the hopper assembly 24 during machine movement and during the hopper assembly 24's switch between the raised position and the lowered position.

Figure 4:
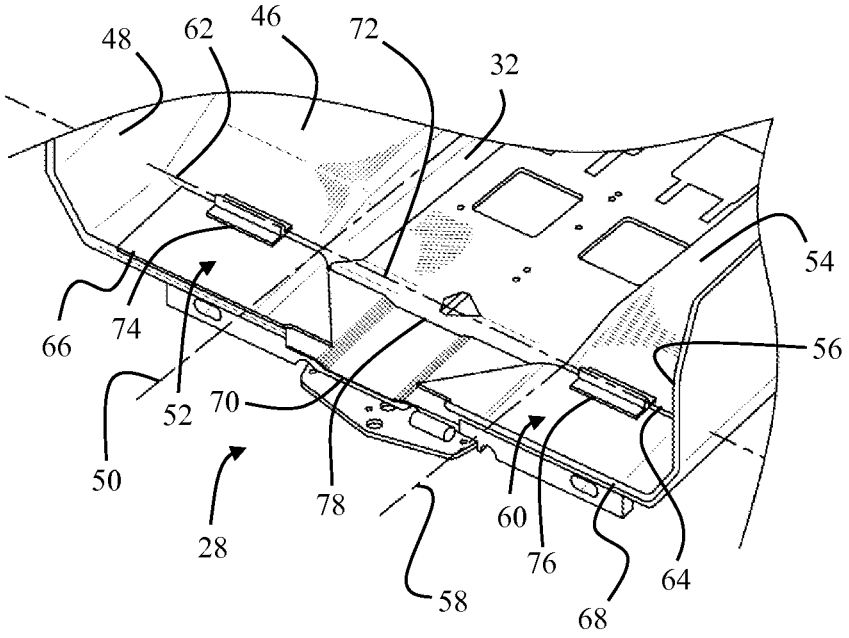
FIG. 4 is a perspective view of a portion of the hopper assembly depicting the layout of apron wing portions as is depicted in FIG. 3 in the lowered position of the hopper assembly.

Referring to FIGS. 3 and 4, a first wing portion 66 of the first apron 40, a second wing portion 68 of the second apron 42, and a central wing portion 70 of the central apron 44, situated at the front end 28 of the paving machine 10 is shown. However, each of the first wing portion 66, the second wing portion 68, and the central wing portion 70 are respectively shown with the first apron 40, the second apron 42, and the central apron 44 being removed, for clarity and understanding.

The first wing portion 66 is integrally connected with the first apron 40. The first wing portion 66 is hinged to the material receipt portion 46 of the first hopper 36 at the first apron axis 62. The first apron axis 62 is substantially perpendicular to the first hopper axis 50 in the lowered position and in the raised position of the hopper assembly 24. This configuration is maintained even as the first hopper 36 is manipulated from the lowered position to the raised position, and vice-versa.

As with the first wing portion 66, the second wing portion 68 is integrally connected with the second apron 42 as well. The second wing portion 68 is hinged to the auxiliary material receipt portion 54 of the second hopper 38 at the second apron axis 64. Similar to the first wing portion 66 and the first apron axis 62, the second apron axis 64 is substantially perpendicular to the second hopper axis 58 in the lowered position and in the raised position of the second hopper 38. This configuration is maintained even as the second hopper 38 is manipulated or translated from the lowered position to the raised position, and even when this translation is reversed.

The central wing portion 70 is also extended integrally from the central apron 44, as has been envisioned for the first wing portion 66 and the second wing portion 68. However, other types of connections between the central apron 44 and the central wing portion 70 may be contemplated, such as involving the use of threaded fasteners that fasten the central wing portion 70 to the central apron 44. The central wing portion 70 is pivotally connected relative to the conveyor frame 32 about a central axis 72.

In an embodiment, first apron axis 62, the second apron axis 64, and the central axis 72, is inline or coincidental with each other, as has been represented by a single axis in FIG. 3. Additionally, it is envisioned that each of the first apron axis 62, the second apron axis 64, and the central axis 72, respectively embody (or accommodate) a first hinge 74, a second hinge 76, and a central hinge 78 (FIG. 4). Further, the first apron axis 62 and the second apron axis 64 are deployed in a manner so as to be substantially inline with the central axis 72 in the lowered position of the hopper assembly 24.

Figure 5:
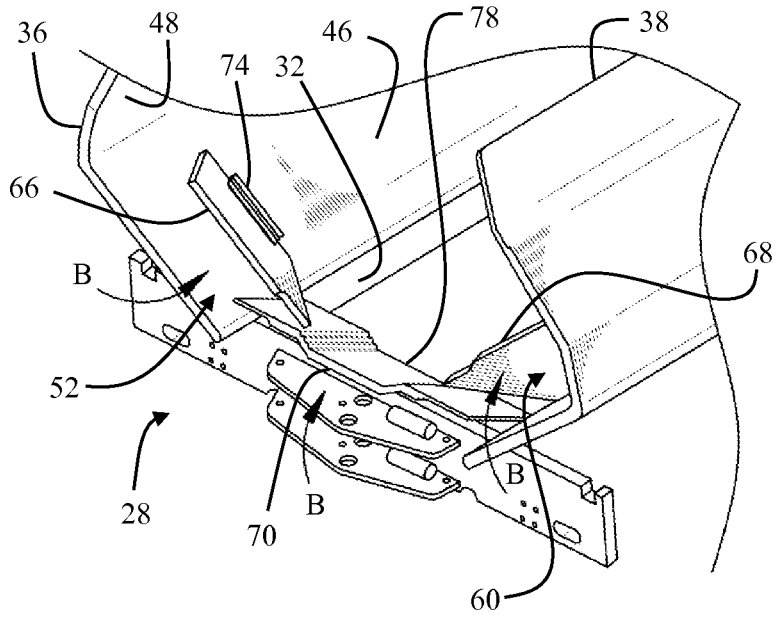
FIG. 5 is a perspective view of a portion of the hopper assembly, with the hopper assembly being in the raised position, in accordance with the concepts of the present disclosure.

Referring to FIG. 5, a general embodiment of the hopper assembly 24 in the raised position is shown. As depicted, the first apron axis 62 (or the first hinge 74) and the second apron axis 64 (or the second hinge 76) are manipulated relative to the central axis 72 (or central hinge 78) and remain no longer inline to the central axis (or central hinge 78). However, the first apron axis (or the first hinge 74) and the second apron axis (or the second hinge 76) are substantially planarly translated relative to the central axis (or central hinge 78) upon the transition of the hopper assembly 24 from the lowered position to the raised position.

INDUSTRIAL APPLICABILITY

In operation, road forming material or paving material is dumped into the hopper assembly 24 and is received onto the material receipt portion 46 and the auxiliary material receipt portion 54 of the hopper assembly 24. Such a delivery occurs while the hopper assembly 24 is in the lowered position. While the road paving material is being dumped, the material support portion 48 and the auxiliary material support portion 56, along with the aprons 40, 42, and 44, (FIG. 2), support and prevent the road paving materials from a fallout relative to the paving machine 10.

During a process of a transition, the paving machine 10 powers a manipulation of the hopper assembly 24 from the lowered position to the raised position. Hydraulic mechanism (not shown) connected to the hopper assembly 24 may facilitate such a transition. Simultaneously, the central apron 44 facilitate a tilt of the first apron 40 and the second apron 42 upwards along an arrow, B, (FIG. 5), respectively about the first apron axis 62 and the second apron axis 64 (FIG. 3). As a result, the road forming materials flow down towards the conveyor portion 22 by gravity feed along an arrow, C (FIG. 2). During this transition, as the first apron axis 62 is inline to the central axis 72, while also being perpendicular to the first hopper axis 50, the road paving material is substantially entirely and uniformly delivered to the conveyor portion 22. This is because the configuration attained with the first apron axis 62 being inline with the central axis 72 and by being perpendicular to the first hopper axis 50 (FIG. 3), restricts the material receipt portion 46 from inheriting an acute-angled corner portion, as seen in conventional designs. As a result, the outflow path 34 (FIG. 2) for the road paving materials remains substantially similar to the general dimensional confines and boundaries of the material receipt portion 46, with negligible structural variations being formed in the material receipt portion 46. Therefore, the outflow path 34 is refrained from being narrower, and an undue retention of a portion of the road forming material is effectively avoided. A similar transitional sequence is envisioned when the road forming materials is transferred from the auxiliary material receipt portion 54 of the second hopper 38 to the conveyor portion 22. Such a configuration of the hopper assembly 24 enables a reduction in the wastage of the road forming material and an undue accumulation of the road forming materials in portions of the hopper assembly 24.

The aspects of the present disclosure may work even with one or more components removed from the hopper assembly 24. Therefore, applications that relate to dumping of a load from a delivery apparatus to a receiving apparatus may suitable apply the concepts of the present disclosure. Accordingly, concepts disclosed here is suitably applicable to multiple environments, and therefore the environment discussed here need not be viewed as being limiting in any way.

It should be understood that the above description is intended for illustrative purposes only and is not intended to limit the scope of the present disclosure in any way. Thus, one skilled in the art will appreciate that other aspects of the disclosure may be obtained from a study of the drawings, the disclosure, and the appended claim.

What is claimed is:

1. A paving machine comprising:

a conveyor portion with a conveyor frame;

a hopper assembly communicable with the conveyor portion and movable between a lowered position and a raised position, the hopper assembly including:

a first hopper pivotally connected to the conveyor frame about a first hopper axis;

a second hopper pivotally connected to the conveyor frame about a second hopper axis;

a first apron with a first wing portion, the first wing portion being pivotally connected to the first hopper about a first apron axis;

a second apron with a second wing portion, the second wing portion being pivotally connected to the second hopper about a second apron axis, wherein the first apron axis and the second apron axis are respectively and substantially perpendicular to the first hopper axis and the second hopper axis; and a central apron pivotally connected relative to the conveyor frame about a central axis, wherein the first apron axis and the second apron axis are substantially in-line to the central axis in the lowered position of the hopper assembly, wherein when the hopper assembly is in the lowered position, the first wing portion and the second wing portion can be in a vertical or horizontal position, wherein the first apron axis and the second apron axis are not in-line relative to the central axis in the raised position of the hopper assembly, the first wing portion and second wing portion being operable by a central wing portion of the central apron.

* * * * *